US011746981B2

(12) United States Patent
Hong et al.

(10) Patent No.: US 11,746,981 B2
(45) Date of Patent: Sep. 5, 2023

(54) MULTI-FACETED REFLECTIVE HIDDEN LIGHTING LAMP AND VEHICLE THEREOF

(71) Applicants: Hyundai Motor Company, Seoul (KR); Kia Corporation, Seoul (KR); Hyundai Mobis Co., Ltd., Seoul (KR)

(72) Inventors: Seung-Pyo Hong, Incheon (KR); Yun-Min Cho, Seoul (KR); Chang-Hwan Oh, Uiwang-si (KR); Dong-Joo Park, Hwaseong-si (KR); Han-Soo Park, Yongin-si (KR); Ju-Hyun Kim, Yongin-si (KR); Jung-Woo Shin, Daegu (KR)

(73) Assignees: HYUNDAI MOTOR COMPANY, Seoul (KR); KIA CORPORATION, Seoul (KR); HYUNDAI MOBIS CO., LTD., Seoul (KR)

( * ) Notice: Subject to any disclaimer, the term of this patent is extended or adjusted under 35 U.S.C. 154(b) by 0 days.

(21) Appl. No.: 17/893,625

(22) Filed: Aug. 23, 2022

(65) Prior Publication Data

US 2023/0235870 A1 Jul. 27, 2023

(30) Foreign Application Priority Data

Jan. 26, 2022 (KR) ..... 10-2022-0011409

(51) Int. Cl.

| | |
|---|---|
| ***F21S 41/365*** | (2018.01) |
| ***F21S 41/176*** | (2018.01) |
| ***F21S 41/143*** | (2018.01) |

(52) U.S. Cl.
CPC ..... *F21S 41/365* (2018.01); *F21S 41/143* (2018.01); *F21S 41/176* (2018.01)

(58) Field of Classification Search
CPC ..... B60Q 1/0011; B60Q 1/26; B60Q 1/28; B60Q 1/30; B60Q 1/301; F21S 41/365
See application file for complete search history.

(56) References Cited

U.S. PATENT DOCUMENTS

| | | | | |
|---|---|---|---|---|
| 4,816,968 | A * | 3/1989 | Yamada | B60Q 1/2661 362/310 |
| 5,504,544 | A | 4/1996 | Dreyer et al. | |
| 11,034,317 | B2 * | 6/2021 | Salter | B60R 19/52 |

(Continued)

*Primary Examiner* — Matthew J. Peerce
(74) *Attorney, Agent, or Firm* — MORGAN, LEWIS & BOCKIUS LLP

(57) ABSTRACT

A multi-faceted reflective hidden lighting lamp applied to a vehicle may block a portion of external light and repeatedly reflect internal light in two or more steps with a reflective surface on one side surface of a light reflective portion having a triangular sawtooth shape formed on a lens in a direction facing a light source and a transmissive surface on the other side surface thereof in an internal space of the lamp, and form a reflective layer on the reflective surface in painting/deposition/plating processes, a laser perforation process, a masking process, and a film insert process to reduce a color conversion material for the same color conversion effect and increase the utilization of an overlap skin portion of the lens, increasing the light blocking ability for a region other than the region required by regulations in addition to increasing the transmissive/light-receiving ability for the region required by regulations.

19 Claims, 11 Drawing Sheets

(56) References Cited

U.S. PATENT DOCUMENTS

| | | | | |
|---|---|---|---|---|
| 2012/0314448 | A1* | 12/2012 | Nakada | F21S 43/245<br>362/602 |
| 2014/0003075 | A1* | 1/2014 | Yamada | B60Q 1/2661<br>362/511 |
| 2017/0357040 | A1* | 12/2017 | Liu | F21S 43/245 |
| 2023/0003360 | A1* | 1/2023 | Studeny | F21S 43/245 |

* cited by examiner

<INTERNAL/EXTERNAL LIGHT SOURCE TRANSMISSIVE STATE (A)>

<INTERNAL/EXTERNAL LIGHT SOURCE TRANSMISSIVE CRITICAL ANGLE STATE (B)>

<EXTERNAL LIGHT SOURCE BLOCKING STATE (C)>

MULTI-FACETED REFLECTIVE HIDDEN LIGHTING LAMP AND VEHICLE THEREOF

CROSS-REFERENCE TO RELATED APPLICATION

The present application claims priority to Korean Patent Application No. 10-2022-0011409, filed on Jan. 26, 2022, the entire contents of which is incorporated herein for all purposes by this reference.

BACKGROUND OF THE PRESENT DISCLOSURE

Field of the Present Disclosure

The present disclosure relates to a hidden lighting lamp, and in particular, to a vehicle to which a multi-faceted reflective hidden lighting lamp in which an optical path may be recycled in an internal space of the lamp with the shape of a light reflective portion capable of the optical path through the reflection of an inclined surface is applied.

Description of Related Art

In general, there is an advantage in that when a hidden lighting lamp is applied to a vehicle, the hidden lighting lamp blocks an internal structure of the lamp in the daytime when a light source is not lit compared to the night when the light source serves as the lamp, implementing a sense of unity with the design of a vehicle so that it is visible through the front or rear appearance of the vehicle (e.g., metal garnish).

This hidden lighting lamp is implemented in a transparent material cover applied type or an opaque material cover applied type.

For example, the transparent material cover structure adds a transparent material cover, which meets the angles 45°±15° required by the lamp light distribution regulations, to a lens. On the other hand, the opaque material cover structure is variously implemented by employing a light-blocking portion by depositing/painting a metal (e.g., Cr, Al) or a color paint, a laser pattern formed by a fine laser processing, which is difficult to identify with the naked eye, a color conversion material by phosphor that improves a color rendering index, etc.

Therefore, through various structures, the hidden lighting lamp may effectively discharge the internal light of the lamp to the outside when the lamp is lit and maintain a shielding function inside the lamp when not lit, and in particular, may also implement the sense of unity with the design of the vehicle together with the design and hidden lamp effect when the vehicle travels in the daytime.

However, each of the transparent material cover structure and the opaque material cover structure applied to the hidden lighting lamp has various problems.

For example, the hidden lighting lamp having the transparent material cover structure has a high degree of exposure of the internal structure of the hidden lighting lamp, may be exposed to direct sunlight, causing a heat resistance problem due to a roof module and exposed to contamination in the lamp (e.g., moisture, haze, or dust), being disadvantageous for the appearance of the lamp, and the entire lamp needs to be disassembled to clean the lamp, inevitably lowering the aesthetic property of the design of the vehicle.

Furthermore, the hidden lighting lamp having the opaque material cover structure converts the optical characteristics of chromaticity and light amount when the light of the light source transmits an opaque layer of the lens, has difficulty in satisfying the regulations due to a change in the optical characteristics and increases an accident rate due to the reduction in visibility, and increases power consumption when the light amount is increased to correct the amount of optical characteristics changed, reducing fuel efficiency (e.g., the fuel efficiency is reduced by 0.2% when the power consumption is increased by 10 W). When the number of light sources is increased to correct the amount of optical characteristics changed, the cost inevitably increases and the fuel efficiency deteriorates because the size and weight of a housing including the lamp and a sensor increases.

Furthermore, a user recently requires the diversification and luxury of hidden lighting images, and there is inevitably a limitation in satisfying the present user needs with the transparent/opaque material cover structures applied to the hidden lighting lamp.

The information included in this Background of the present disclosure is only for enhancement of understanding of the general background of the present disclosure and may not be taken as an acknowledgement or any form of suggestion that this information forms the prior art already known to a person skilled in the art.

BRIEF SUMMARY

Various aspects of the present disclosure are directed to providing a multi-faceted reflective hidden lighting lamp and a vehicle thereof, in which the reflection of an inclined surface including the shape of a light reflective portion applied to an internal space of the lamp contributes to an optical path configured for a light recycling, increasing a light transmittance of a light source of the lamp and increasing a light-blocking rate of an external light source, and metal deposition/laser pattern/phosphor are combined with the shape of the light reflective portion using painting/deposition processes, a laser perforation, a masking process, a film insert process, the addition of a separate layer, a double layer, etc. To reduce a color conversion material for the same color conversion effect and increase the utilization of an overlap skin portion of the lens, increasing the light-blocking ability for a region other than the region required by regulations in addition to increasing the transmissive/light-receiving ability of the region required by the regulations.

A hidden lighting lamp according to an exemplary embodiment of the present disclosure for achieving the object includes: a light source; a lens provided for facing the light source and projecting a light of the light source to the outside; and a light reflective portion provided on the lens in a sawtooth shape and repeatedly reflecting the light in two or more steps in a state of forming a first side surface of the sawtooth shape as a reflective surface and forming a second side surface of the sawtooth shape as a transmissive surface to face the light source.

As an exemplary embodiment of the present disclosure, the sawtooth shape is formed in a triangular sawtooth structure by combining an upward inclination straight line of the reflective surface and a horizontal straight line of the transmissive surface.

As the exemplary embodiment of the present disclosure, the reflective surface is formed with the upward inclination straight line at 45°±15°, and the transmissive surface is formed with the horizontal straight line at 0°±15°.

As the exemplary embodiment of the present disclosure, an additional material is applied to the reflective surface by painting a transparent paint and depositing a metal, which is any one of Al, Ni, and Cr, and the additional material forms a reflective layer from which the light of the light source is reflected.

As the exemplary embodiment of the present disclosure, when a color conversion material is applied to the reflective surface, the color conversion material is phosphor that color-converts the light of the light source.

As the exemplary embodiment of the present disclosure, the reflective surface is provided with an additional material of Al, Ni, and Cr and a color conversion material of phosphor, and the additional material is positioned below the color conversion material or positioned above the color conversion material.

As the exemplary embodiment of the present disclosure, the lens is coupled to a lens skin to form the light reflective portion as an air gap light reflective portion, the air gap light reflective portion is configured by matching the light reflective portion of the lens with a reverse-phased light reflective portion of the lens skin, the light reflective portion and the reverse-phased light reflective portion are formed with an overlap section in which a non-reflection light output including the sawtooth shape is prevented as an optic non-application section, and the optic non-application section is formed with a medium passing section and an empty space passing section through which the light of the light source is transmitted.

As the exemplary embodiment of the present disclosure, the light reflective portion has a layer formed on the reflective surface, the layer is formed of a metal layer made of any one of Al, Cr, and Ni and a phosphor layer, and the metal layer is positioned below the phosphor layer or positioned above the phosphor layer.

As the exemplary embodiment of the present disclosure, the light reflective portion has a reflective layer formed on the reflective surface, and the reflective layer is formed by the metal deposition to which any one of Al, Cr, and Ni is applied in any one of painting/deposition/plating processes, a laser perforation process, a masking process, and a film insert process.

As the exemplary embodiment of the present disclosure, the painting/deposition/plating processes forms the metal deposition on the reflective surface of the light reflective portion.

As the exemplary embodiment of the present disclosure, the laser perforation process forms the metal deposition on the reflective surface and the transmissive surface of the light reflective portion, and removes the metal of the transmissive surface by laser perforation.

As the exemplary embodiment of the present disclosure, the masking process forms the metal deposition on the reflective surface in a state of covering the transmissive surface of the light reflective portion with masking, and removes the masking of the transmissive surface.

As the exemplary embodiment of the present disclosure, the film insert process forms the metal deposition on the reflective surface in a state of foaming the transmissive surface of the light reflective portion with a film, and performs an insert injection.

Furthermore, a vehicle according to an exemplary embodiment of the present disclosure for achieving the object includes: a hidden lighting lamp configured to block a portion of external light and to repeatedly reflect light of a light source in two or more steps in an internal space of the lamp with a reflective surface on one side surface of a light reflective portion having a triangular sawtooth shape formed on a lens in a direction facing the light source and a transmissive surface on the other side surface thereof, and a vehicle lamp mounting portion including the hidden lighting lamp positioned thereon.

As an exemplary embodiment of the present disclosure, the hidden lighting lamp is any one of a head lamp, a tail lamp, a fog lamp, a turn signal lamp, a side repeater, an emergency light, a brake lamp, and a back up lamp.

The hidden lighting lamp applied to the vehicle according to an exemplary embodiment of the present disclosure implements the following operations and effects.

First, the hidden lighting lamp may utilize the multi-faceted reflective optical path of the internal space of the lamp using the reflective shape of the inclined surface of the light reflective portion, increasing the light transmittance of the light source of the lamp and increasing the light-blocking rate of the external light source, and reducing the exposure of the internal structure, protecting confidentiality and preventing the leakage of the technology. Second, even if the hidden lighting lamp is applied to the conventional method used for the reflective surface, because the hidden lighting lamp may utilize the multi-faceted reflective optical path of the shape of the light reflective portion, it is possible to reduce the amount of optical characteristics changed to reduce the misidentification of the function of the hidden lighting lamp, reducing the risk of the accidents. Third, it is possible to reduce the number of light sources by increasing the light amount, reducing the cost and the weight, and to reduce the power consumption due to the increase in transmittance, improving the fuel efficiency (e.g., the effect in which the fuel efficiency is increased by 0.2% when the power consumption is reduced by 10 W). Fourth, it is possible to increase the light-blocking rate of the external light source with the reflective shape of the inclined surface of the light reflective portion to reduce the exposure of the direct sunlight to the space of the hidden lighting lamp, protecting the expensive components. Fifth, it is possible to improve the appearance of the hidden lighting lamp by reducing the exposure to the internal contamination (e.g., moisture, haze, or dust), reducing the cleaning in the lamp and the A/S required rate. Sixth, it is possible to combine the metal deposition/laser pattern/phosphor with various processes (e.g., painting/deposition, laser perforation, masking, film insert, and the modification of layer) with respect to the shape of the light reflective portion of the multi-faceted reflective optical path, implementing the same color conversion effect even by reducing the color conversion material and increasing the utilization of the overlap skin portion of the lens, and to increase the light-blocking ability of the region other than the region required by the regulations in addition to increasing the transmissive/light-receiving ability of the region required by the regulations for the hidden lighting lamp.

The methods and apparatuses of the present disclosure have other features and advantages which will be apparent from or are set forth in more detail in the accompanying drawings, which are incorporated herein, and the following Detailed Description, which together serve to explain certain principles of the present disclosure.

Figure 1A:
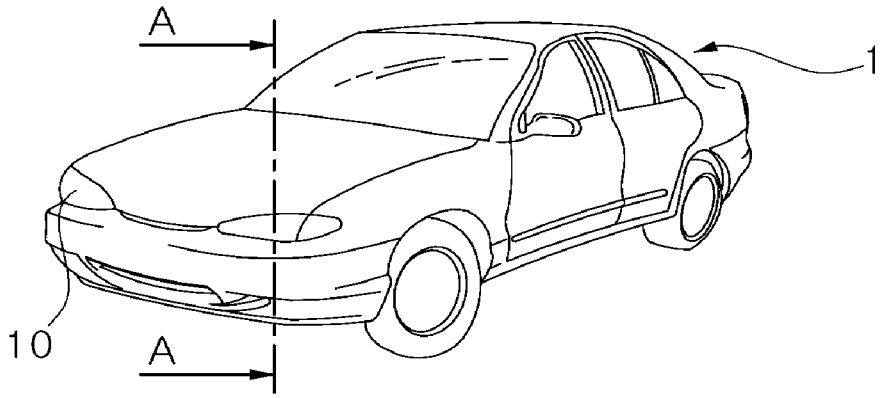
FIG. 1A and FIG. 1B are configuration views of a multi-faceted reflective hidden lighting lamp applied to a vehicle according to an exemplary embodiment of the present disclosure.

It may be understood that the appended drawings are not necessarily to scale, presenting a somewhat simplified representation of various features illustrative of the basic principles of the present disclosure. The specific design features of the present disclosure as disclosed herein, including, for example, specific dimensions, orientations, locations, and shapes will be determined in part by the particularly intended application and use environment.

In the figures, reference numbers refer to the same or equivalent parts of the present disclosure throughout the several figures of the drawing.

DETAILED DESCRIPTION

Reference will now be made in detail to various embodiments of the present disclosure(s), examples of which are illustrated in the accompanying drawings and described below. While the present disclosure(s) will be described in conjunction with exemplary embodiments of the present disclosure, it will be understood that the present description is not intended to limit the present disclosure(s) to those exemplary embodiments of the present disclosure. On the other hand, the present disclosure(s) is/are intended to cover not only the exemplary embodiments of the present disclosure, but also various alternatives, modifications, equivalents and other embodiments, which may be included within the spirit and scope of the present disclosure as defined by the appended claims.

Hereinafter, an exemplary embodiment of the present disclosure will be described in detail with reference to the accompanying exemplary drawings, and the present exemplary embodiment of the present disclosure is illustrative and may be implemented by those skilled in the art to which the present disclosure pertains in various different forms, and therefore, is not limited to the exemplary embodiment described herein.

Figure 1B:
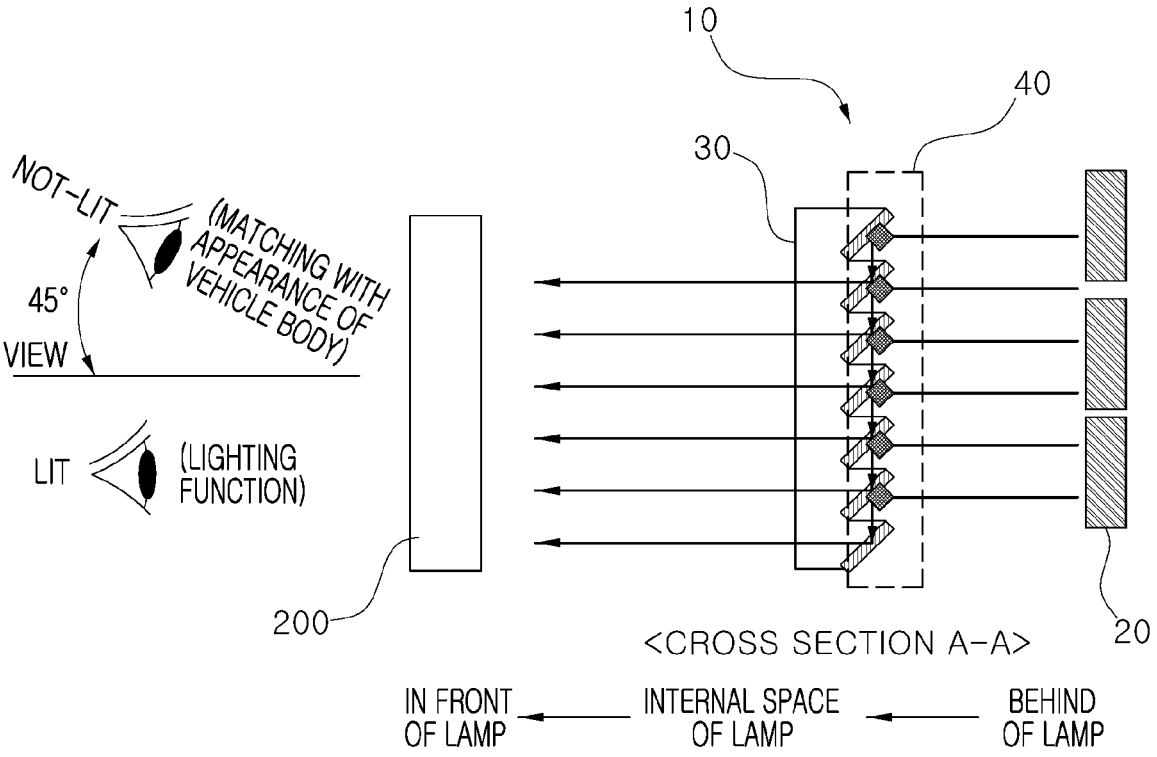

Referring to FIG. 1A and FIG. 1B, a vehicle 1 has a hidden lighting lamp 10 provided on a vehicle lamp mounting portion.

For example, the vehicle lamp mounting portion indicates a vehicle front bumper portion, and the hidden lighting lamp 10 indicates a headlamp. However, the vehicle lamp mounting portion may be applied to the rear surface of the vehicle or the side surface of the vehicle, and in the instant case, the hidden lighting lamp 10 may be any one of a tail lamp, a fog lamp, a turn signal lamp, a side repeater, an emergency light, a brake lamp, and a back up lamp.

Referring to a cross section A-A of FIG. 1A, the hidden lighting lamp 10 includes a light source 20 configured to generate light in an internal space of the lamp, a lens 30 positioned on the front of the light source 20 and transmitting and repeatedly reflecting the light of the light source 20 to a multi-faceted reflective element 41 (see FIG. 2A and FIG. 2B) of a light reflective portion 40 or an air gap light reflective portion 70 (see FIG. 5A, FIG. 5B and FIG. 5C) to reflect internal light twice or more, and an external lens 200 exposed to the outside. In the instant case, the hidden lighting lamp 10 is provided with a lamp housing, power source/signal connectors, a wire harness, an aiming bolt, etc. as basic components.

For example, the light source 20 is formed of a light emitting diode (LED) CHIP (or CHIP LED), and is a light-emitting diode (LED) type that generates light when electricity is supplied in a principle of a PN junction light emitting diode. In the instant case, the light source 20 can employ, as light of the lighting, a light bulb (BULB), an organic light-emitting diode (OLED), a laser light source, etc. which may utilize the light property such as the transmission, reflection, refraction, and diffusion.

For example, the lens 30 and the external lens 200 use a transparent material, and generally employ a plastic (e.g., a polycarbonates (PC) material), a glass material, and a polymethyl methacrylate (PMMA) material. The lens 30 combines one or more among phosphor, black painting, and coating/application/deposition layers, and the external lens 200 has its rear surface, as a painting surface, rather than an externally exposed front surface in a transparent state to match with the appearance color of the vehicle (e.g., garnish).

In other words, the hidden lighting lamp 10 is configured as the garnish by matching the external lens 200 with the appearance color of a vehicle body in an upper view of about 450 compared to a front view that performs a lighting function.

Therefore, the hidden lighting lamp 10 may effectively discharge light by blocking a part of external light for a region other than the light distribution region required by regulations and repeatedly reflecting internal light in two or more steps with the characteristics of the multi-faceted reflective element 41 using the light reflective portion 40 of the lens 30, easily match an observation layer of the external lens 200 visible from the appearance with a target chromaticity of the light-emitting diode (LED) CHIP of the light source 20 by correcting the light of the color conversion material (or color conversion layer), and protect the contamination of the lens 30 using the air gap light reflective portion 70, and is characterized as the multi-faceted reflective hidden lighting lamp 10 by implementing these various functions.

Meanwhile, FIGS. 2A, 2B, 3A, 3B and 3C show a detailed structure of the light reflective portion 40 applied to the lens 30.

Figure 2A:
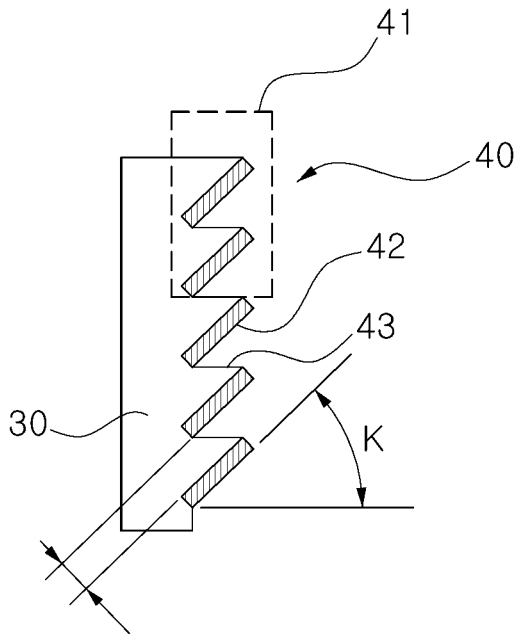
FIG. 2A and FIG. 2B show examples of a structure of a multi-faceted reflective light reflective portion according to an exemplary embodiment of the present disclosure.
Figure 2B:
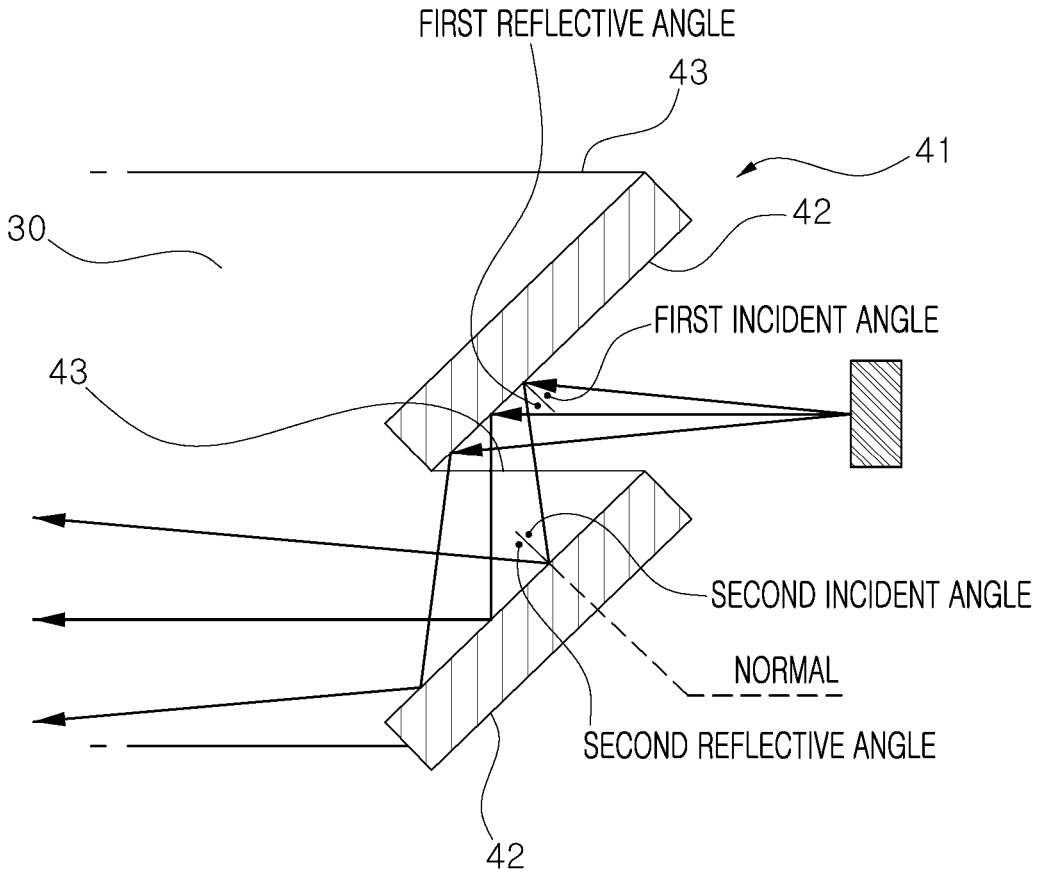

Referring to FIG. 2A and FIG. 2B, the lens 30 has front and rear surfaces formed in a predetermined width thickness, in which the front surface faces the external lens 200 in the internal space of the lamp, while the rear surface faces the light source 20 in the internal space of the lamp and therefore, the lens 30 is formed of a transmissive member including the shape of a reflective surface 42 including a predetermined angle and a transmissive surface 43.

The light reflective portion 40 has a multi-faceted reflective shape of a sawtooth structure with triangular saw blades continuously provided in the longitudinal direction from the rear surface of the lens 30, and the shape of the triangular saw blade is classified into the reflective surface 42 which is an upward inclined straight line and the transmissive surface 43 which is a horizontal straight line and therefore, the light reflective portion 40 is formed of the triangular saw blade of an isosceles triangle.

The reflective surface 42 is provided with an additional material 80 by coating a transmissive paint or depositing a metal. In other words, the reflective surface 42 is formed with a post-processed portion for reflecting the light of the light source 20 by applying any one of the Al deposition treatment, which is the metal deposition, the NI-CR plating treatment, and the AL deposition treatment together with painting, and the white plating which is a transmissive paint painting, and the transmissive surface 43 is formed as a portion having the reflective material removed, through which light is easily transmitted. In the instant case, the transmissive surface 43 is manufactured in a state where the deposition through masking or laser perforation is not applied in an initial state.

For example, the reflective surface 42 has the upward inclination straight line formed at a reflective portion inclination angle (K), and the reflective portion inclination angle (K) is set as about 45° with respect to an H-V direction angle which is a reference front angle at which the light distribution of the single lamp is measured, or the direction of the ground line which is an angle horizontal to the ground surface of the vehicle. In the instant case, the reflective portion inclination angle (K) may be applied as 45° 15° (i.e., 30 to 60°) considering that 45° is adjusted to above/below 15° as the angles required by the regulations.

Therefore, because the light reflective portion 40 is formed with one multi-faceted reflective element 41 by forming a pair of two adjacent triangular saw blades, a plurality of light reflective portions 40 are continuously formed depending upon the number of triangular saw blades, the reflective surface 42 has the reflective surface 42 on one of the pair of triangular saw blades as a first reflective surface and the reflective surface 42 on the other triangular saw blade side as a second reflective surface, separately, and the transmissive surface 43 is horizontally positioned between the first reflective surface and the second reflective surface facing each other.

For example, the reflective surface 42 is formed by equally applying the reflective portion inclination angle (K) to the first reflective surface and the second reflective surface and therefore, the first and second reflective surfaces minimize the change in the angle with respect to each other.

The first reflective surface of the reflective surface 42 and the second reflective surface of the reflective surface 42 adjacent thereto, that is, two reflective surfaces parallel to each other have the same light of the light source 20 based on the law of reflection in which a first incident angle and a first reflective angle are the same with respect to a normal, and according to the present characteristic, the first reflective angle including an alternate angle is similar to a second incident angle and therefore, the second incident angle and a second reflective angle are the same according to the law of reflection. Therefore, the first and second reflective surfaces may be set to minimize the change in the angle by the principle that the first incident angle and the second reflective angle are the same.

Therefore, the two reflective surfaces parallel to each other (i.e., the first and second reflective surfaces) are formed to be as parallel as possible to have similar properties to each other. However, if this is allowed by considering the point that the two reflective surfaces parallel to each other (i.e., first and second reflective surfaces) may send the light of the light source 20 in the required range with respect to the fluctuation within 15°, the first and second reflective surfaces may be differently set in consideration of the aspect of the lamp design.

Furthermore, the reflective surface 42 is post-processed to increase the reflectivity compared to the conventional lens, and as the type of post-processing for the above, aluminum deposition, chrome plating, paint painting, etc., which are the methods for forming a lamp reflector, may be used.

For example, the transmissive surface 43 may be positioned between the first and second reflective surfaces of the reflective surface 42, and formed at a transmissive portion angle within about 0°±15° with respect to a single lamp authentication direction or the ground line, minimizing the amount of loss fully reflected when the light emitted from the light source 20 is transmitted. In the instant case, the reason why the transmissive portion angle is set as 15° is that the range of sending the light of the light source 20 is an allowable value which is effective for sending the light to the region required by regulations.

As described above, each of the multi-faceted reflective elements 41 forming the light reflective portion 40 is formed with the first reflective surface of the reflective surface 42, the transmissive surface 43 facing the first reflective surface, and the second reflective surface of the reflective surface 42 formed below the transmissive surface 43, and therefore, the light emitted from the light source 20 transmits the lens 30 by the operation of the multi-faceted reflective element 41 in the light reflective portion 40.

In other words, the light emitted from the light source 20 and directed to the light reflective portion 40 of the lens 30 is reflected from the front of the first reflective surface of the reflective surface 42 toward the transmissive surface 43 positioned between the first and second reflective surfaces at a first reflective angle which is the same angle as the first incident angle with respect to a normal, the light passing through the transmissive surface 43 is directed to the second reflective surface of the reflective surface 42, and the rear of the second reflective surface of the reflective surface 42 reflects the light coming from the first reflective surface at a second reflective angle which is the same angle of the second incident angle with respect to a normal to be discharged through the lens 30.

Therefore, the light emitted from the light source 20 is discharged to the outside of the hidden lighting lamp 10 through the external lens 200. In the instant case, when a sensor is applied instead of the light source 20, the sensor may detect light in a reverse order direction of the light source 20—the lens 30—the external lens 200.

Figure 3A:
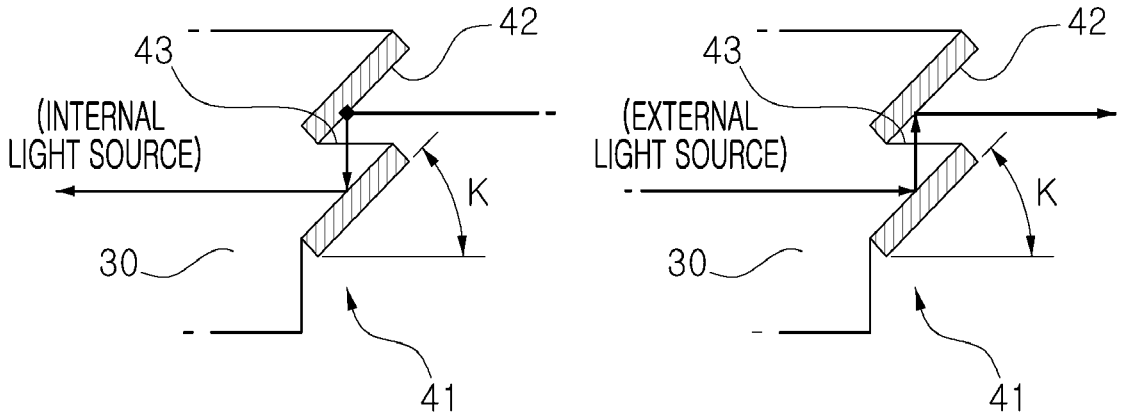
FIG. 3A, FIG. 3B and FIG. 3C show examples of an operation of the light reflective portion that transmits a light source of the lamp and blocks an external light source according to an exemplary embodiment of the present disclosure.
Figure 3B:
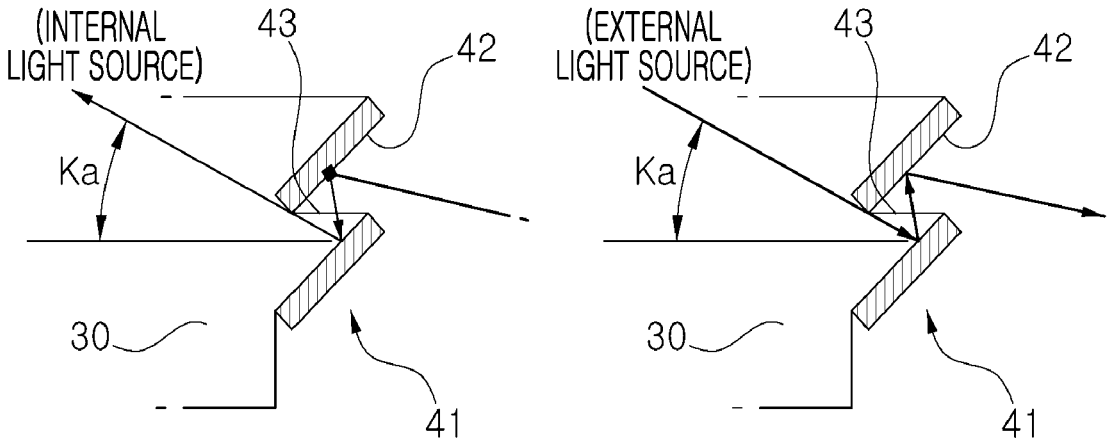
Figure 3C:
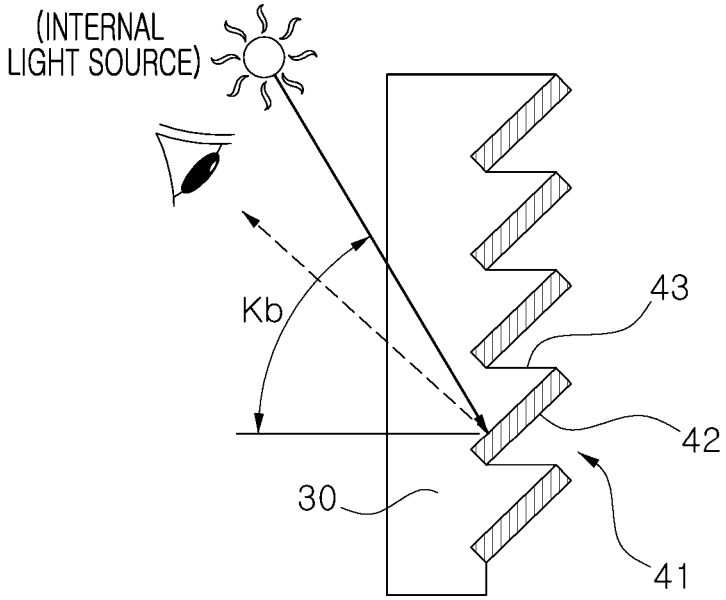

FIG. 3A, FIG. 3B and FIG. 3C show an internal/external light source transmissive state (A), an internal/external light source transmissive critical angle state (B), and an external light source blocking state (C) of the light reflective portion 40.

For example, the internal/external light source transmissive state (A) represents that the internal light source (i.e., the light of the light source 20) is discharged from the lens 30 through the front of the first reflective surface of the reflective surface 42—the transmissive portion 43—the rear of the second reflective surface of the reflective surface 42, while the external light source (i.e., sunlight) enters the lens 30 through the rear of the second reflective surface of the reflective surface 42—the transmissive surface 43—the front of the first reflective surface of the reflective surface 42 at the reflective portion inclination angle (K) of 45°.

Therefore, based on the internal/external light source transmissive state (A), the internal/external light source transmissive critical angle state (B) exemplifies a light source transmissive critical angle (Ka) at which the light of each of the internal light source (i.e., the light emitted from the light source 20) and the external light source (i.e., sunlight) may transmit the lens 30. In the instant case, the light source transmissive critical angle (Ka) is set as a maximum of 300 in the range of 45°±15°.

Therefore, in the internal/external light source transmissive critical angle state (B), it is possible to increase the reflection and the transmission in the region within 45°±15°, increasing the internal light and the lamp optical efficiency, and to increase a light-receiving rate of the external light, increasing the sensor light-receiving efficiency in the lamp.

As an example and based on the internal/external light source transmissive state (A), the external light source blocking state (C) exemplifies a light source transmissive blocking angle (Kb) at which the external light source (i.e., sunlight) may not transmit the lens 30. In the instant case, the light source transmissive blocking angle (Kb) is set as a maximum of 60° in the range of 45±15°.

Therefore, in the external light source blocking state (C), it is possible to exert the hidden effect in which sunlight is blocked (i.e., reflection is blocked) with a gaze view of blocking the reflection of the external light in the region of 45°±150 or more.

Meanwhile, FIG. 4 and FIG. 5 show various modified structures of the light reflective portion 40.

Figure 4A:
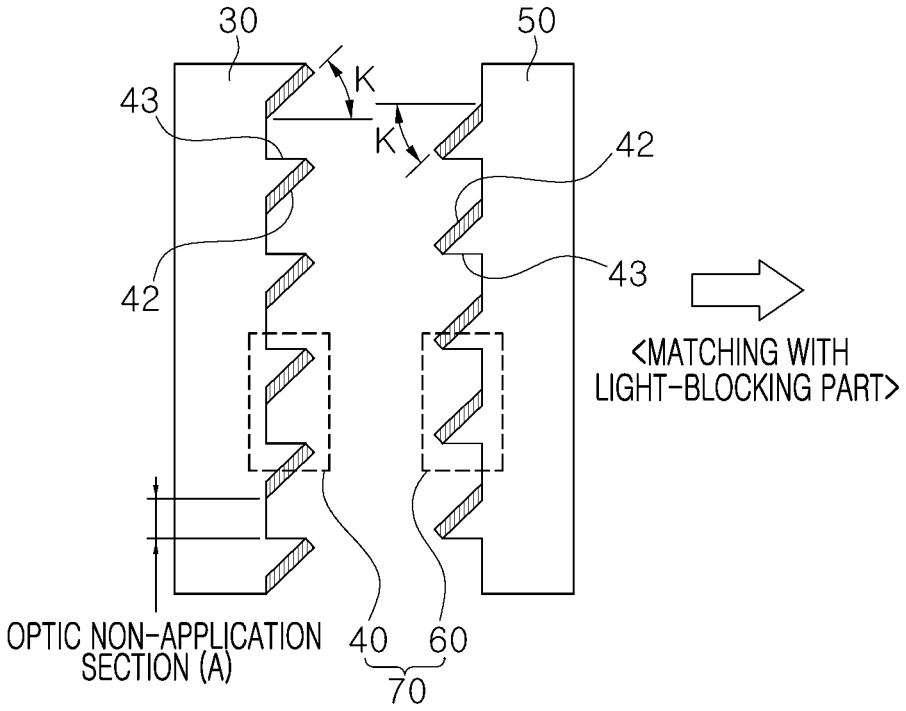
FIG. 4A, FIG. 4B and FIG. 4C show examples in which the light reflective portion according to an exemplary embodiment of the present disclosure is configured as an air gap light reflective portion in combination with a reversed-phase light reflective portion.
Figure 4B:
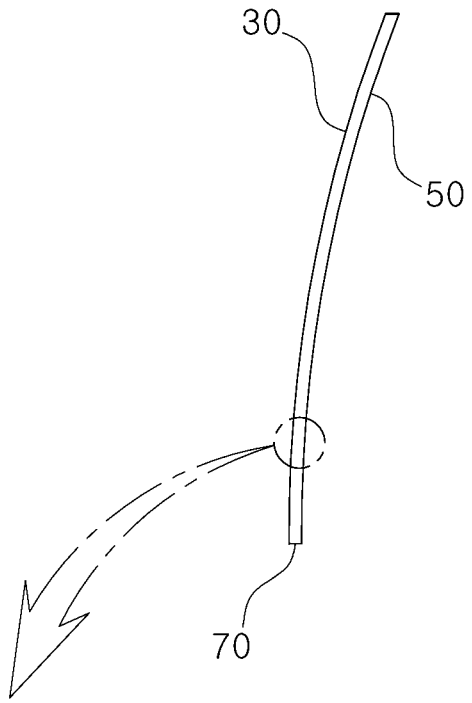
Figure 4C:
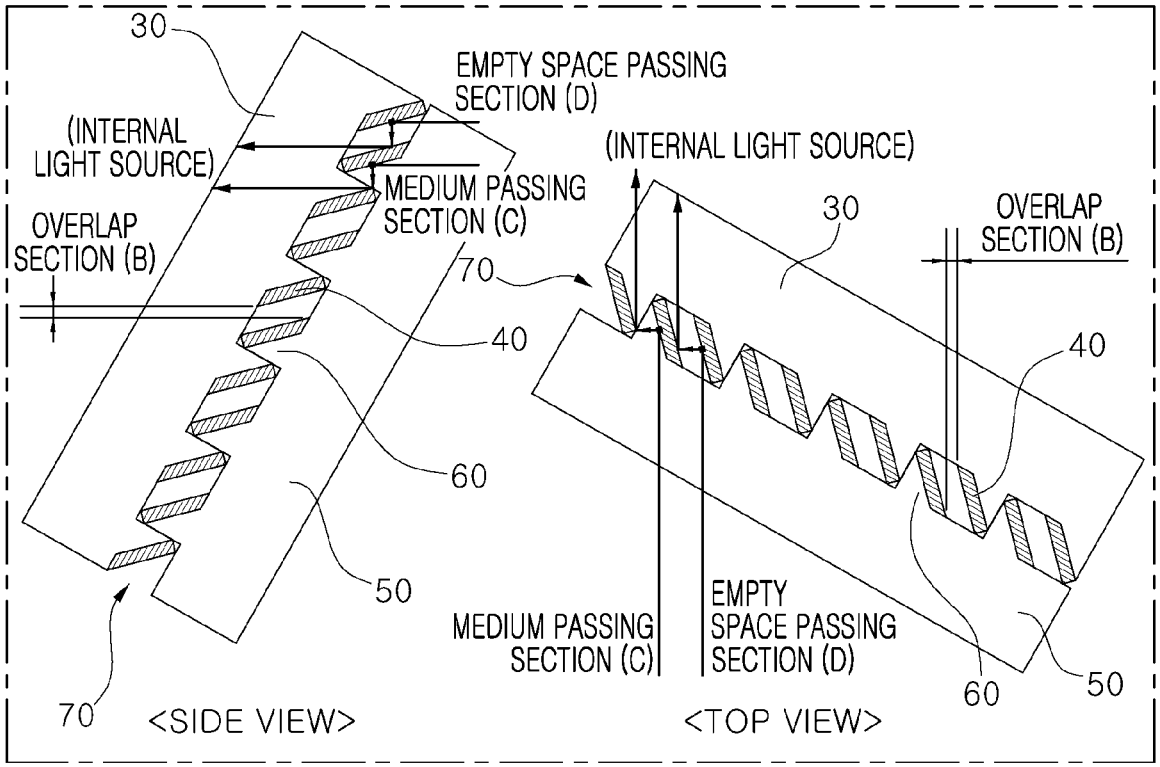

FIG. 4A, FIG. 4B and FIG. 4C show examples in which the light reflective portion 40 is modified into the air gap light reflective portion 70.

The air gap light reflective portion 70 is formed between the lens 30 and a lens skin 50 by use of the lens 30 and the lens skin 50. In the instant case, the lens skin 50 is in close contact with the rear surface of the lens 30 to be arranged to face the light source 20.

For example, the air gap light reflective portion 70 includes the light reflective portion 40 of the lens 30 and a reversed-phase light reflective portion 60 of the lens skin 50, and in an optic non-application section (A) formed on each of the light reflective portion 40 and the reversed-phase light reflective portion 60, the triangular saw blades including the multi-faceted reflective element 41 are spaced from each other to form the column of the adjacent triangular saw blade.

Each of the light reflective portion 40 and the reversed-phase light reflective portion 60 is formed with the reflective surface 42 and the transmissive surface 43 described with reference to FIG. 1, FIG. 2, and FIG. 3, and the reflective surface 42 is formed with the reflective portion inclination angle (K) of about 45°±15° (i.e., 30 to 60°) with respect to the H-V direction angle which is the reference front angle at which the light distribution of the single lamp is measured or the direction of the ground line which is the angle horizontal to the ground surface of the vehicle.

For example, in a side view and a top view of the air gap light reflective portion 70, the light reflective portion 40 of the lens 30 and the reversed-phase light reflective portion 60 of the lens skin 50 is overlapped by the matching of the optic non-application section (A) and therefore, the column of the triangular saw blade of the air gap light reflective portion 70 is formed with an overlap section (B) between the adjacent triangular saw blades.

The overlap section (B) may minimize a section which may not be covered, such as setting a planar section, operate so that the light of the light source 20 may maintain the reflective path on the reflective surface 42 and the transmissive surface 43, and be reduced depending upon the reflective portion inclination angle (K) (or skin lens matching angle). Furthermore, the overlap section (B) may have an adjustable interval depending upon the planar sections of the light reflective portion 40 and the reverse-phased light reflective portion 60 and the size of the mountain of the triangular saw blade so that the multi-faceted reflective element 41 may perform the secondary or more reflection.

Therefore, the air gap light reflective portion 70 is formed with a medium passing section (C) and an empty space passing section (D) in a state of preventing the non-reflective light output of the optic non-application section (A) in the overlap section (B), and in the medium passing section (C) and the empty space passing section (D), the air gap light reflective portion 70 may implement the optical direction similar to the optical directions of the first and second reflective surfaces of the reflective surface 42 and the transmissive surface 43 described with reference to FIGS. 1A and 1B, FIGS. 2A and 2B, and FIGS. 3A, 3B and 3C.

Figure 5A:
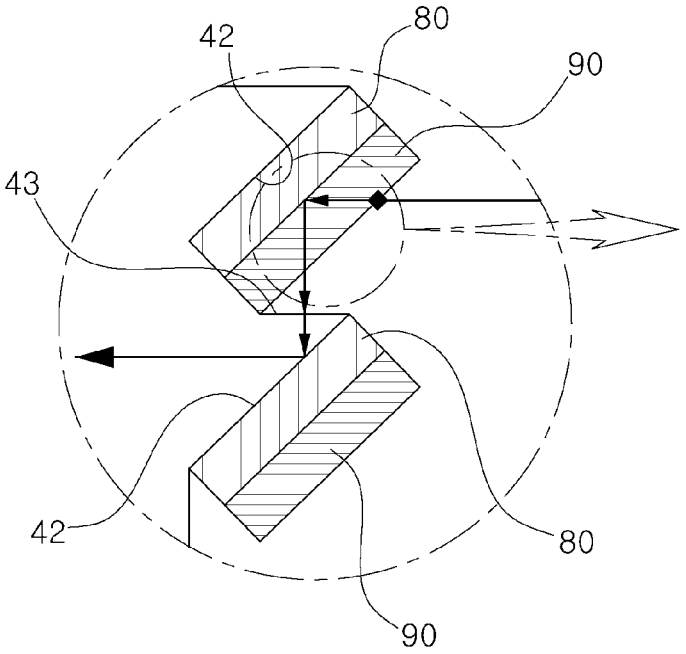
FIG. 5A, FIG. 5B and FIG. 5C show examples in which a metal deposition and a color conversion material are applied to the light reflective portion to improve the amount of optical characteristics changed according to an exemplary embodiment of the present disclosure.
Figure 5B:
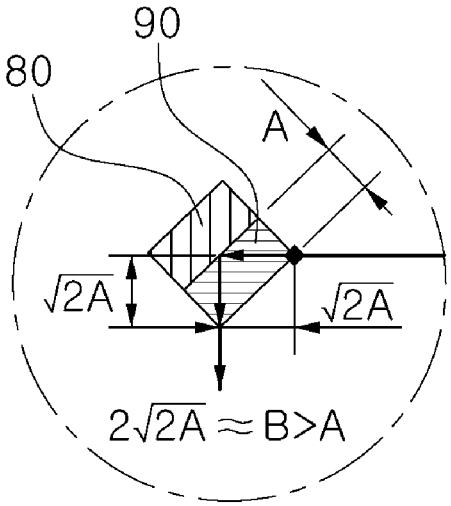
Figure 5C:
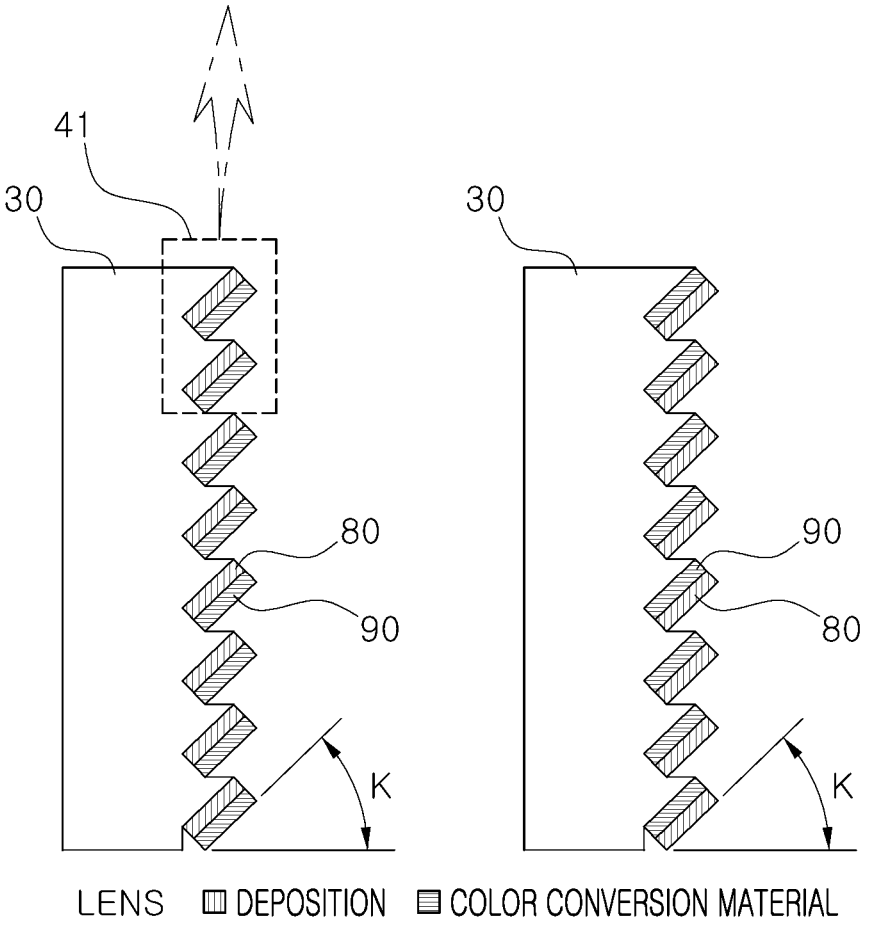

FIG. 5A, FIG. 5B and FIG. 5C show a structure in which a separate additional layer is applied to the light reflective portion 40 of the lens 30, and the additional layer includes the additional material 80 and a color conversion material 90 applied to the reflective surface 42 of the triangular saw blade forming the multi-faceted reflective element 41.

For example, the additional material 80 makes the reflective surface 42 a reflective layer from which the light is reflected by painting the transmissive paint deposited on the reflective surface 42 through aluminum deposition, chrome plating, or nickel-chrome plating process with the reflective material such as Al, Cr, or Ni.

The additional material 80 may be covered by the color conversion material 90 in a state of being deposited on the reflective surface 42 of the light reflective portion 40 or deposited on the color conversion material 90 applied to the reflective surface 42 of the light reflective portion 40.

For example, the color conversion material 90 makes the reflective surface 42 the reflective layer from which the light is reflected and color-converts the light of the light source 20 by applying phosphor for improving the color rendering index on the reflective surface 42.

The color conversion material 90 forms a light source path at the reflective portion inclination angle (K) of about 45° of the reflective surface 42 of the light reflective portion 40, and therefore, the light source path may be made long according to the relationship of B ($\approx 2\sqrt{2}A$)>A. In the instant case, in the thickness of the 45° inclined application layer of the color conversion material 90, "A" refers to the length of the inclined surface around 45° as the bottom (or thickness), and "B" refers to the path recycling length through reflection as the inclined surface.

Therefore, the color conversion material 90 increases the incident path of the light source 20 to the length of about 1.4 times due to the inclined surface effect and increases the reflective path of the light source 20 to the length of about twice due to the reflection effect, increasing the path of the light source by about 2.8 times.

Therefore, the color conversion material 90 may increase the utilization of the expensive color conversion material with the characteristics of the path of the light source increased by about 2.8 times, implementing the same color conversion effect even when the amount of the color conversion material used is reduced by up to about 65% compared to the conventional one.

Figure 6:
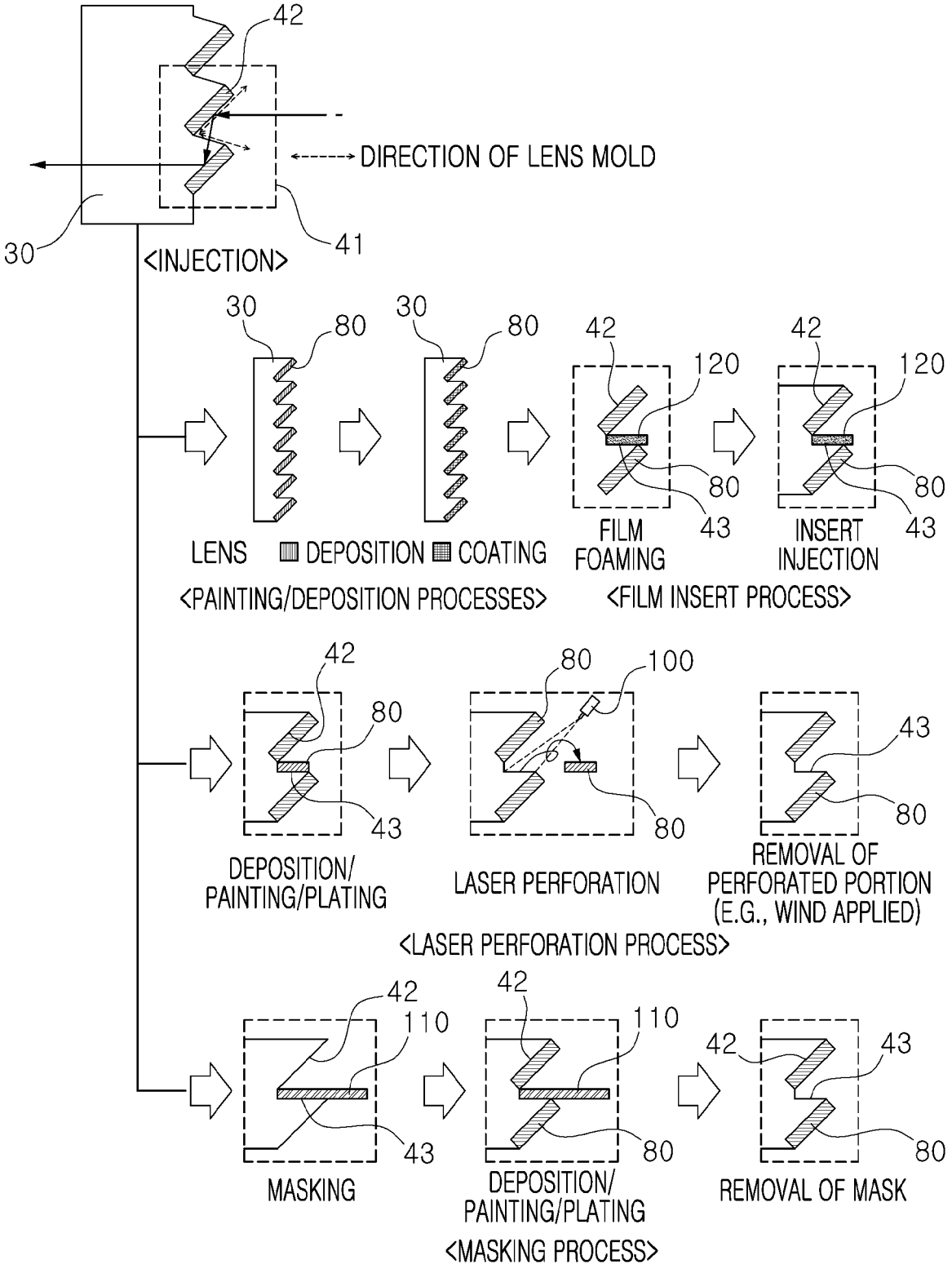
FIG. 6 shows an example of an injection process, painting/deposition processes, a laser perforation process, a masking process, and a film insert process applied to manufacturing the light reflective portion according to an exemplary embodiment of the present disclosure.

Meanwhile, FIG. 6 shows various manufacturing processes in which the light reflective portion 40 is applied to the lens 30 and the lens 30 is formed of the multi-faceted reflective lens 30.

For example, referring to the injection process, the light reflective portion 40 adjusts the angle of the reflective surface 42 to angles of 30 to 60° that are the angles required by regulations within the angles of about 45°±15° with respect to the ground line of the vehicle or the lamp authentication front H-V direction, and the transmissive surface 43 is set so that the H-V direction and the optical path form 90°±15° (i.e., within vertically ±15°) to preserve the light going in the H-V direction if possible in consideration of the characteristics in that the amount of light required based on H-V is the largest.

Therefore, the lens mold is set based on about 450 which is the reflective portion inclination angle (K) applied to the reflective surface 42 and the transmissive surface 43 and a direction of the lens mold is positioned between the reflective surface 42 and the transmissive surface 43, so that the incident angle of the lamp proceeds in the same direction (i.e., parallel) as that of an output angle thereof, reducing the degree of interference to the light output within 150 of the front of the vehicle.

Therefore, the injection process may pull upward the direction of the lens mold because the transmissive surface 43 becomes the inclined surface during injection through the direction of the lens mold set between the angle formed by the reflective surface 42 and the transmissive surface 43.

As described above, the injection process may manufacture the multi-faceted reflective lens 30 in which the incident angle of the lamp of the light source 20 may proceed in the same direction (i.e., parallel) as the output angle thereof, reducing the degree of interference by the light output from the light source 20 within 150 of the front of the vehicle, and the multi-faceted reflective lens 30 may preserve the light going in the H-V direction as much as possible through the transmissive surface 43 set so that the H-V direction and the optical path are perpendicular (within +15°) in consideration of the characteristics in that the amount of light required based on H-V is the largest.

The multi-faceted reflective lens 30 may strengthen its function through the painting/deposition processes and the film insert process after the injection process.

For example, the painting/deposition processes may make the reflective surface 42 of the light reflective portion 40 of the lens 30, which is injected by depositing (e.g., Al) or coating (e.g., Cr/Cr—Ni plating) Al, Cr, or Ni which is the additional material 80, the reflective layer with Al, Cr, or Ni. In the instant case, if the characteristics of the deposition and the physical properties of the lens 30 do not match with each other, the deposition through the BASE coating may be performed in consideration of the point that a peeling phenomenon such as crack may occur.

Furthermore, the film insert process may form the reflective layer on the first and second reflective surfaces of the reflective surface 42 in the methods for depositing/painting/plating Al, Cr, or Ni which is the additional material 80 in a state of foaming the transmissive surface 43 of the light reflective portion 40 of the injected lens 30 with a film 120, and then integrate the film 120 by insert injection so that the reflective layer may be formed on the reflective surface 42 and at the same time, formed on the transmissive surface 43.

Furthermore, the multi-faceted reflective lens 30 may strengthen its function through the laser perforation process.

For example, the laser perforation process may form the reflective layer on the first and second reflective surfaces of the reflective surface 42 and the transmissive portion 43 of the light reflective portion 40 of the injected lens 30 in the methods for depositing/painting/plating Al, Cr, or Ni which is the additional material 80, and remove only the additional material 80 of the transmissive surface 43 by the laser perforation, performing the deposition/painting/plating more easily. In the instant case, the additional material 80 of the transmissive surface 43 removed by the laser perforation may be removed by the wind of a blower.

Furthermore, the repeated reflective lens 30 may strengthen its function through the masking process.

For example, the masking process may cover the transmissive surface 43 of the light reflective portion 40 of the injected lens 30 with a masking 110, then form the reflective layer on the first and second reflective surfaces of the reflective surface 42 in the methods for depositing/painting/plating Al, Cr, or Ni which is the additional material 80, and then remove the masking 110, so that the reflective layer may be formed on the reflective surface 42 and at the same time, formed on the transmissive surface 43.

As described above, the lens 30 is manufactured as the multi-faceted reflective lens 30 to which the light reflective portion 40 is applied through the injection process, and then any one of the painting/deposition processes, the laser perforation process, the masking process, and the film insert process is applied to the reflective surface 42 and the transmissive surface 43 of the light reflective portion 40, and therefore, there is an advantage in that the first and second reflective surfaces of the reflective surface 42 may form the reflective layer in various methods so that a portion of the external light for the region other than the light distribution region required by regulations may be blocked and the internal light may be repeatedly reflected in the two or more steps.

As described above, the multi-faceted reflective hidden lighting lamp 10 applied to the vehicle 1 according to the exemplary embodiment of the present disclosure may block a portion of the external light and at the same time, repeatedly reflect the internal light in the two or more steps with the reflective surface 42 on one side surface of the light reflective portion 40 including the triangular sawtooth shape formed on the multi-faceted reflective lens 30 in the direction facing the light source 20 and the transmissive surface 43 on the other side surface thereof in the internal space of the lamp, so that the reflection of the inclination surface type multi-faceted structure including the shape of the light reflective portion applied to the internal space of the lamp may form the optical path of the light path recycling.

Therefore, the multi-faceted reflective hidden lighting lamp 10 may increase the transmittance of the light of the light source 20 of the lamp and increase the light blocking rate of the external light source (i.e., sunlight), and the reflective surface 42 may form the reflective layer in the painting/deposition/plating processes, the laser perforation process, the masking process, and the film insert process to reduce the color conversion material for the same color conversion effect and increase the utilization of the overlap skin portion of the lens, increasing the light blocking ability for the region other than the region required by the regulations in addition to increasing the transmissive/light-receiving ability for the region required by the regulations.

For convenience in explanation and accurate definition in the appended claims, the terms "upper", "lower", "inner", "outer", "up", "down", "upwards", "downwards", "front", "rear", "back", "inside", "outside", "inwardly", "outwardly", "interior", "exterior", "internal", "external", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of predetermined exemplary embodiments of the present disclosure have been presented for purposes of illustration and description. They are not intended to be exhaustive or to limit the present disclosure to the precise forms disclosed, and obviously many modifications and variations are possible in light of the above teachings. The exemplary embodiments were chosen and described in order to explain certain principles of the invention and their practical application, to enable others skilled in the art to make and utilize various exemplary embodiments of the present disclosure, as well as various alternatives and modifications thereof. It is intended that the scope of the present disclosure be defined by the Claims appended hereto and their equivalents.

What is claimed is:

1. A hidden lighting lamp apparatus comprising:

a light source;

a lens provided for facing the light source and projecting a light of the light source to the outside; and a light reflective portion provided on the lens in a sawtooth structure and repeatedly reflecting the light by a first side surface of the sawtooth structure as a reflective surface and a second side surface of the sawtooth structure as a reflective and transmitting surface to face the light source, wherein the lens is coupled to an opposing lens to form the light reflective portion as an air gap light reflective portion, and wherein the air gap light reflective portion is configured by matching the light reflective portion of the lens with an opposite light reflective portion of the opposing lens.

2. The hidden lighting lamp apparatus of claim 1, wherein the sawtooth structure is formed by combining an upward inclination straight line of the reflective surface and a horizontal straight line of the reflective and transmitting surface.

3. The hidden lighting lamp apparatus of claim 2, wherein the reflective surface is formed with the upward inclination straight line at 45°±15°, and the reflective and transmitting surface is formed with the horizontal straight line at 0°±15°.

4. The hidden lighting lamp apparatus of claim 1, wherein a reflective layer is applied to the reflective surface by painting a transparent paint and depositing a metal, and the reflective layer forms a reflective layer from which the light of the light source is reflected.

5. The hidden lighting lamp apparatus of claim 4, wherein the depositing of the metal is performed by depositing of the metal with one of Al, Ni, and Cr.

6. The hidden lighting lamp apparatus of claim 1, wherein when a color conversion material is applied to the reflective surface, the color conversion material is phosphor that color-converts the light of the light source.

7. The hidden lighting lamp apparatus of claim 1, wherein the reflective surface is provided with an additional material of Al, Ni, and Cr and a color conversion material of phosphor, and wherein the additional material is positioned below the color conversion material or positioned above the color conversion material.

8. The hidden lighting lamp apparatus of claim 1, wherein the light reflective portion and the opposite light reflective portion are formed with an overlap section in which a non-reflection light output including the sawtooth structure is prevented as an optic non-application section, and wherein the optic non-application section is formed with a medium passing section and an empty space passing section through which the light of the light source is transmitted.

9. The hidden lighting lamp apparatus of claim 1, wherein the light reflective portion has a layer formed on the reflective surface, and the layer is a metal layer and a phosphor layer.

10. The hidden lighting lamp apparatus of claim 9, wherein the metal layer is one of Al, Cr, and Ni.

11. The hidden lighting lamp apparatus of claim 9, wherein the metal layer is positioned below the phosphor layer or positioned above the phosphor layer.

12. A vehicle comprising:

the hidden lighting lamp apparatus of claim 1, configured to block a portion of external light and to repeatedly reflect the light of the light source in an internal space of the hidden lighting lamp apparatus with the reflective surface on a first side surface of the light reflective portion having a triangular sawtooth structure formed on the lens in a direction facing the light source and the reflective and transmitting surface on a second side surface thereof; and a vehicle lamp mounting portion having the hidden lighting lamp apparatus positioned thereon.

13. A method of forming the reflective layer for the hidden lighting lamp apparatus of claim 1, including the light source, the lens provided for facing the light source and projecting the light of the light source to the outside, and the light reflective portion provided on the lens in the sawtooth structure and repeatedly reflecting the light by the first side surface of the sawtooth structure as the reflective surface and the second side surface of the sawtooth structure as the reflective and transmitting surface to face the light source, the method comprising:

forming the reflective layer by depositing a metal in one of painting/deposition/plating processes, a laser perforation process, a masking process, and a film insert process, wherein the depositing of the metal includes performing the depositing of the metal with one of Al, Cr, and Ni, wherein the painting/deposition/plating processes forms the metal deposition on the reflective surface of the light reflective portion, wherein the laser perforation process forms the metal deposition on the reflective surface and the reflective and transmitting surface of the light reflective portion, and removes the metal of the reflective and transmitting surface by laser perforation, wherein the masking process forms the metal deposition on the reflective surface in a state of covering the reflective and transmitting surface of the light reflective portion with masking, and removes the masking of the reflective and transmitting surface, and wherein the film insert process forms the metal deposition on the reflective surface in a state of foaming the reflective and transmitting surface of the light reflective portion with a film, and performs an insert injection.

14. The method of claim 13, wherein the light reflective portion has a reflective layer formed on the reflective surface, and wherein the reflective layer is formed by depositing the metal in any one of the painting/deposition/plating processes, the laser perforation process, the masking process, and the film insert process.

15. The method of claim 14, wherein the depositing of the metal is performed by depositing of the metal with one of Al, Cr, and Ni.

16. The method of claim 14, wherein the painting/deposition/plating processes forms the metal deposition on the reflective surface of the light reflective portion.

17. The method of claim 14, wherein the laser perforation process forms the metal deposition on the reflective surface and the reflective and transmitting surface of the light reflective portion, and removes the metal of the reflective and transmitting surface by the laser perforation.

18. The method of claim 14, wherein the masking process forms the metal deposition on the reflective surface in a state of covering the reflective and transmitting surface of the light reflective portion with masking, and removes the masking of the reflective and transmitting surface.

19. The method of claim 14, wherein the film insert process forms the metal deposition on the reflective surface in a state of foaming the reflective and transmitting surface of the light reflective portion with a film, and performs an insert injection.

* * * * *